US011488799B1

(12) United States Patent
Polyakov

(10) Patent No.: US 11,488,799 B1
(45) Date of Patent: Nov. 1, 2022

(54) HEATERS FOR HOLLOW CATHODES

(71) Applicant: PIPL LIMITED, Nicosia (CY)

(72) Inventor: Maxym Polyakov, Edinburgh (GB)

(73) Assignee: PIPL LIMITED, Nicosia (CY)

( * ) Notice: Subject to any disclaimer, the term of this patent is extended or adjusted under 35 U.S.C. 154(b) by 0 days.

(21) Appl. No.: 17/871,511

(22) Filed: Jul. 22, 2022

(51) Int. Cl.
*H01J 1/22* (2006.01)
*H01J 9/08* (2006.01)
*H01J 1/02* (2006.01)

(52) U.S. Cl.
CPC ..... *H01J 1/22* (2013.01); *H01J 1/025* (2013.01); *H01J 9/08* (2013.01)

(58) Field of Classification Search
CPC ..... H01J 1/22; H01J 1/025; H01J 9/08
See application file for complete search history.

(56) References Cited

U.S. PATENT DOCUMENTS

2005/0285498 A1* 12/2005 Komiya ..... H01J 1/22 313/446
2007/0222358 A1* 9/2007 Shonka ..... H01J 1/025 313/339
2009/0226752 A1* 9/2009 Barratt ..... H01J 61/06 428/595
2019/0027335 A1* 1/2019 Chiba ..... H01J 3/029

* cited by examiner

*Primary Examiner* — Anne M Hines
(74) *Attorney, Agent, or Firm* — Georgiy L. Khayet

(57) ABSTRACT

A heater for a hollow cathode and a method for manufacturing the heater for the hollow cathode are provided. An example heater includes a tube and a thickening located at an edge of the tube. The tube has a side wall of a predetermined thickness and a cut in the side wall. The thickening is configured for attaching two electrical current leads. The tube and the thickening are made of a carbon fiber composite.

20 Claims, 5 Drawing Sheets

HEATERS FOR HOLLOW CATHODES

TECHNICAL FIELD

This disclosure relates to rocket and space technology. More specifically, this disclosure relates to heaters for hollow cathodes used in electric propulsion thrusters used in spacecrafts.

BACKGROUND

Hollow cathodes are widely used in electric propulsion thrusters, such as ion thrusters and Hall-effect thrusters. Typically, in an ion thruster, one hollow cathode is located inside a gas discharge chamber and is used to form a discharge current, and another hollow cathode is located outside the ion thruster and performs the neutralization of the ion beam. In a Hall-effect thruster, one hollow cathode is located outside the thruster and simultaneously performs two tasks. The first task is providing a discharge current in an acceleration channel, and the second task is neutralization of the ion beam at the thruster's outlet. The reliability and lifetime of the hollow cathode is crucial for the reliability and lifetime of the entire electric propulsion thruster.

Heaters are used to preheat emitters of hollow cathodes before starting the electric propulsion thrusters. Conventional heaters used in hollow cathodes are made of a tungsten-rhenium alloy. However, the cyclic mode of operation and temperature differences occurring during the operation of such heaters lead to oxidation, recrystallization, and increased brittleness of the heaters, which can result in failures of the heaters and, accordingly, failures of the electric propulsion thrusters.

SUMMARY

This summary is provided to introduce a selection of concepts in a simplified form that are further described in the Detailed Description below. This summary is not intended to identify key features or essential features of the claimed subject matter, nor is it intended to be used as an aid in determining the scope of the claimed subject matter.

Generally, the present disclosure is directed to heaters for hollow cathodes and methods for manufacturing heaters for hollow cathodes. According to one example embodiment of the present disclosure, a heater for a hollow cathode is provided. The heater includes a tube having a side wall of a predetermined thickness and a cut in the side wall. The heater may further include a thickening located at an edge of the tube and configured for attaching two electrical current leads. The tube and the thickening are manufactured of a carbon fiber composite.

According to another example embodiment of the present disclosure, a method for manufacturing a heater for a hollow cathode is provided. The method may include manufacturing, from a carbon fiber composite, a tube having a side wall of a predetermined thickness. The method may continue with making a cut in the side wall. The method may further include manufacturing, from the carbon fiber composite, a thickening at an edge of the tube. The thickening may be configured for attaching two electrical current leads.

Other example embodiments of the disclosure and aspects will become apparent from the following description taken in conjunction with the following drawings.

BRIEF DESCRIPTION OF DRAWINGS

Exemplary embodiments are illustrated by way of example and not limitation in the figures of the accompanying drawings, in which like references indicate similar elements.

DETAILED DESCRIPTION

The following detailed description of embodiments includes references to the accompanying drawings, which form a part of the detailed description. Approaches described in this section are not prior art to the claims and are not admitted to be prior art by inclusion in this section. The drawings show illustrations in accordance with example embodiments. These example embodiments, which are also referred to herein as "examples," are described in enough detail to enable those skilled in the art to practice the present subject matter. The embodiments can be combined, other embodiments can be utilized, or structural, logical, and operational changes can be made without departing from the scope of what is claimed. The following detailed description is, therefore, not to be taken in a limiting sense, and the scope is defined by the appended claims and their equivalents.

Generally, the embodiments of this disclosure relate to heaters for hollow cathodes and methods for manufacturing heaters for hollow cathodes. A heater may include a tube and a thickening located at an edge of the tube. The tube may have a side wall of a predetermined thickness and a cut in the side wall. The thickening may be configured for attaching two electrical current leads. The tube and the thickening can be made of a carbon fiber composite.

Figure 1:
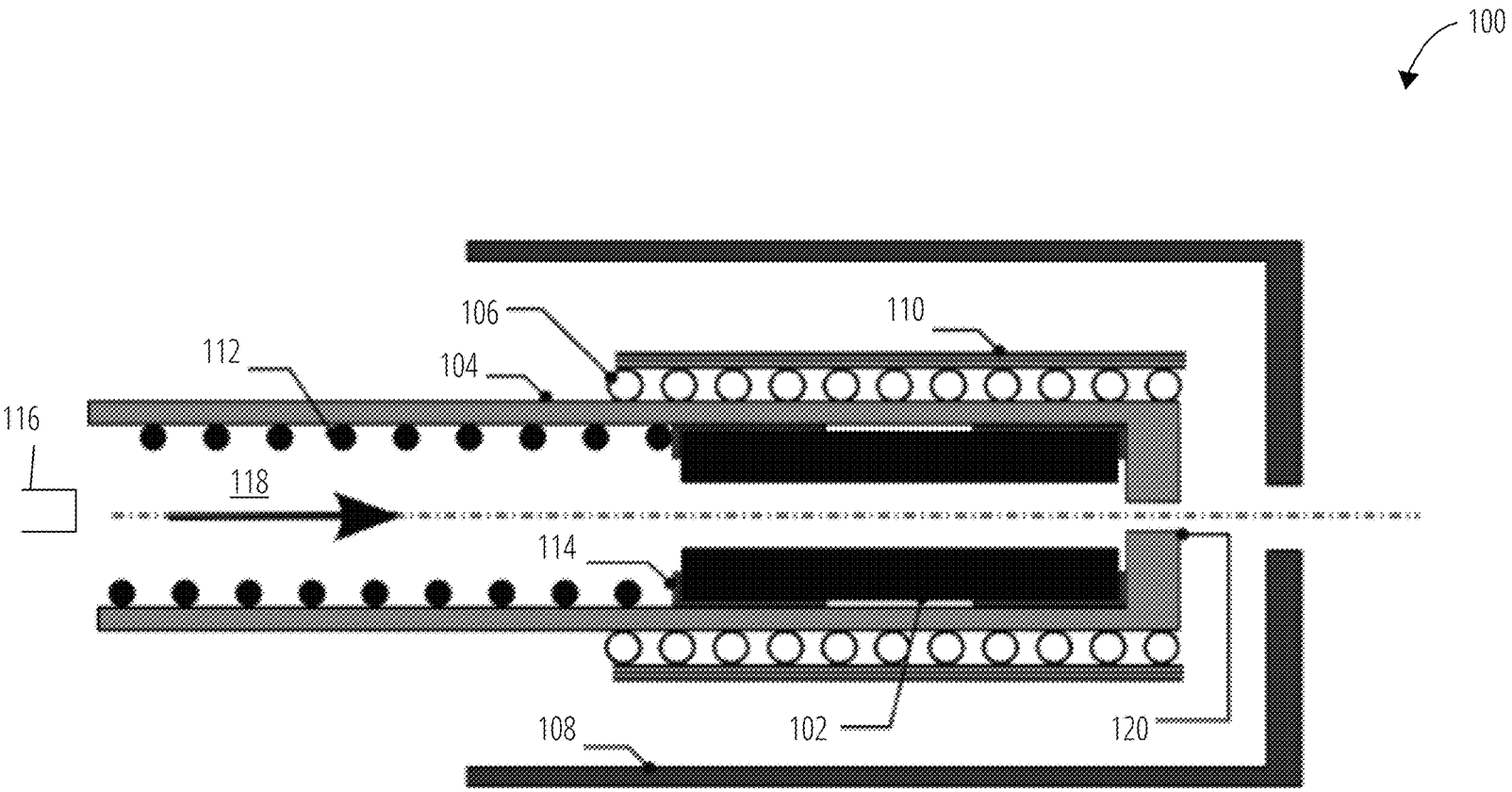
PRIOR ART FIG. 1
FIG. 1 is a diagram of a hollow cathode with a conventional heater used in electric propulsion thrusters.

FIG. 1 is a diagram of a hollow cathode 100 with a conventional heater used in electric propulsion thrusters. The hollow cathode 100 may include an emitter 102, which is a source of electrons and is located inside a working tube 104 of the hollow cathode 100. The hollow cathode 100 may further include a heater 106, which provides preheating of the emitter 102 to the operating temperature. The heater 106 can be made in the form of a spiral. The hollow cathode 100 may further include a keeper 108 that operates as an external electrode configured to create and maintain an internal arc discharge in the hollow cathode 100. The hollow cathode 100 may further include heat shields 110 that provide the predetermined thermal conditions during the operation of the hollow cathode 100. The hollow cathode 100 may further include a spring 112 that supports the emitter 102 in the working area of the working tube 104. The emitter 102 may be placed into a sleeve 114 disposed inside the working tube 104. When supporting the emitter 102 in the working area, the spring 112 may be in contact with the sleeve 114 rather than with the emitter 102. The hollow cathode 100 may further include a supply tube 116. A working substance shown as a gas flow 118 is fed through the supply tube 116 into the hollow cathode 100. The working tube 104 may further include an orifice 120 for outputting the internal arc discharge.

During the operation of the hollow cathode 100, the temperature of the emitter 102 should be provided at a level sufficient for carrying out the process of thermal electron emission. Several types of emitters 102 can be used in the hollow cathode 100 (for example, a barium oxide-calcium oxide-aluminum oxide ($BaO-CaO-Al_2O_3$)-based emitter and a lanthanum hexaboride ($LaB_6$)-based emitter). When the $BaO-CaO-Al_2O_3$-based emitter is used, the temperature of the emitter should be 1000-1100° C. When the $LaB_6$-based emitter is used, the temperature of 1500-1600° C. should be provided.

In the process of preparing the hollow cathode 100 for start, the emitter 102 needs to be preheated. The preheating of the emitter 102 is carried out by the heater 106 through which an electric current is passed from a separate power supply source. After starting the thruster, the power supply source of the heater 106 is switched off, and the operating temperature of the emitter 102 is maintained by the discharge current of the thruster.

The heater 106 operates in a wide temperature range, namely from the environmental temperature to the operating temperature of the emitter 102, at which the process of thermal electron emission occurs. Most often, a material used for the wire of the heater 106 of the hollow cathode 100 is a tungsten-rhenium (W-Re) alloy. The W-Re alloy ensures the operability of the heater 106 over the entire operating temperature range of the emitter 102. However, the cyclic mode of operation of the heater 106 and a wide range of temperature differences lead to oxidation, recrystallization, and increased brittleness of the W-Re alloy of the heater 106. As a result of the long-term cyclic operation of the heater 106 made from the W-Re alloy, the reliability of the heater 106 decreases, which can even result in a complete failure of the heater 106.

In contrast to conventional heaters, the heaters of the present disclosure are made of a carbon fiber composite. The carbon fiber composite is also known as a carbon fiber-reinforced polymer, a carbon fiber-reinforced plastic, and a carbon fiber-reinforced thermoplastic. The carbon fiber composite is an extremely strong and light fiber-reinforced plastic material that contains carbon fibers. The properties of the carbon fiber composite also include high strength-to-weight ratio and stiffness (rigidity). Physical and mechanical characteristics of the carbon fiber composite make it possible to eliminate the main disadvantages specific to the W-Re alloy used for conventional heaters, such as oxidation, recrystallization, increased brittleness of the W-Re alloy, and lowering of the reliability of the heater that results in failure of the heater.

The advantages of the carbon fiber composite include low density from 1.35 to 1.85 g/sm3, high mechanical properties in a wide temperature range from −100 to +2200° C., high resistance to thermal shock, and the ability to maintain shape and geometric dimensions during cyclic heating. The temperature coefficient of linear expansion of the carbon fiber composite is at the level of 0.5×10-6 to 3×10-6 1/K. The specific electrical resistivity of the carbon fiber composite at the temperature of 20° C. is from 36 to 40 Ohm*mm2/m and decreases with the increase of the temperature. The carbon fiber composite preserves its electrical properties over time, can operate in a pulse current mode, and is chemically resistant to oxidizing and reducing environments.

Figure 2:
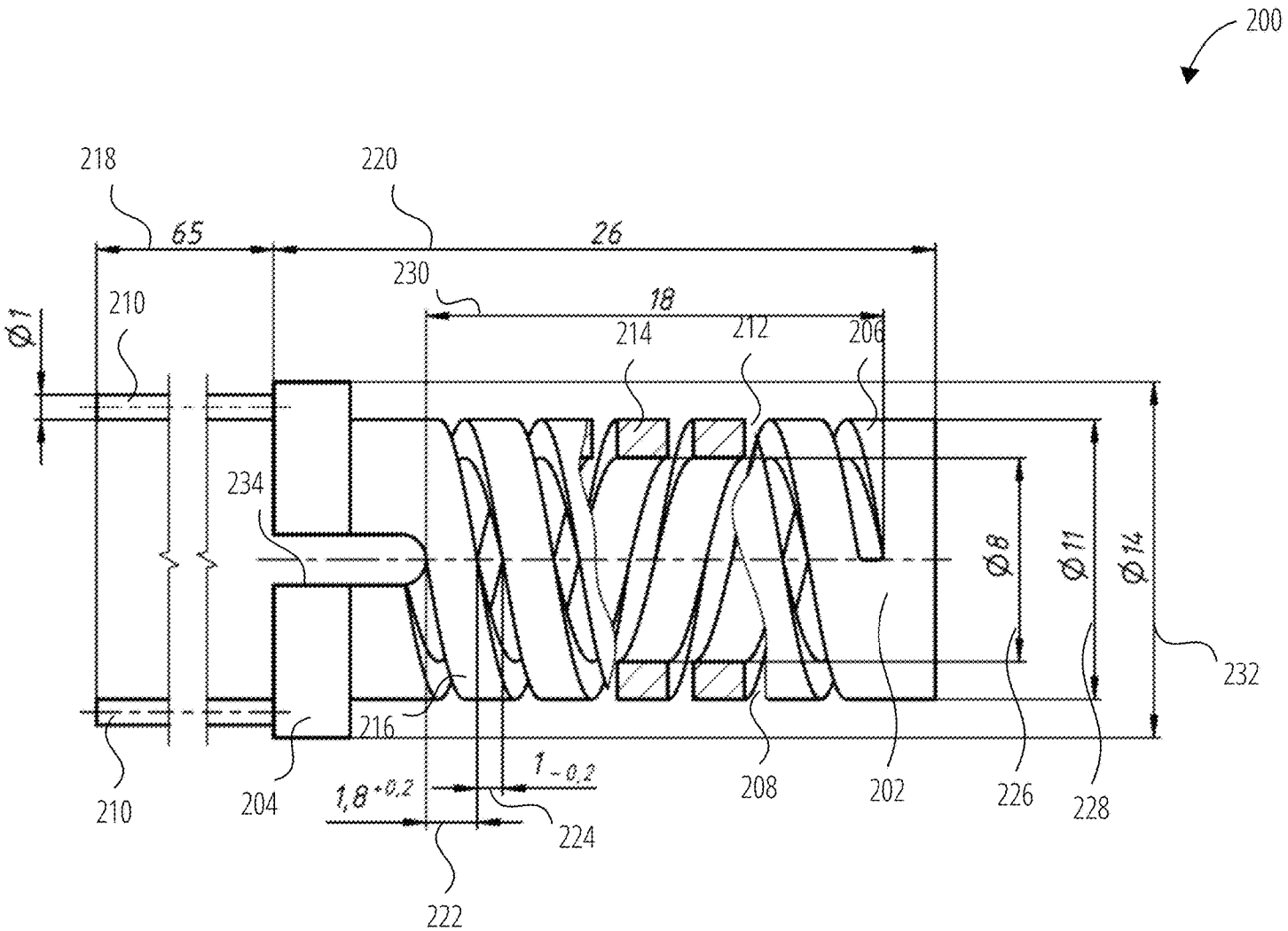
FIG. 2 is a view of a heater for a hollow cathode, according to an example embodiment.

FIG. 2 is a view of a heater 200 for a hollow cathode, according to an example embodiment of present disclosure. The heater 200 can be made from a carbon fiber composite. The heater 200 may include a tube 202 and a thickening 204 located at an edge of the tube 202. The tube 202 may have a side wall 206 of a predetermined thickness and a cut 208 in the side wall 206. The thickening 204 may be configured for attaching two electrical current leads 210.

The purpose of making the cut 208 is to increase the active electrical resistance of the heater 200 between the electrical current leads 210 attached to thickening 204. In general, the shape of the cut 208 may be selected based on predetermined conditions for ensuring the mechanical rigidity and strength of the heater 200. The cut 208 can be in the shape of a slit directed lengthwise alongside the side wall 206 (for example, a longitudinal slit) or in the shape of the spiral slit 212 located around the side wall 206 as shown in FIG. 2. However, the shape of the cut 208 is not limited to a longitudinal shape or a spiral shape and may include other shapes selected based on the predetermined conditions.

The purpose of making the thickening 204 is to facilitate attaching the two electrical current leads 210 to the heater 200 because thickness of the side wall 206 of the tube 202 may be inapplicable for the reliable connecting to the two electrical current leads 210. Moreover, the thickening 204 may facilitate the fastening of the heater 200 in a hollow cathode (shown in detail in FIG. 3). In an example embodiment, the tube 202 and the thickening 204 maybe manufactured as a single part.

Because the heater 200 is made of a carbon fiber composite, the heater 200 has mechanical rigidity sufficient for simplifying the process of attaching an insulator to a working tube in a hollow cathode.

In the example embodiment shown in FIG. 2, the heater 200 may include one or more grooves 234. The one or more grooves 234 may be cut through the whole length of the thickening 204 and through a portion of the length of the tube 202. The one or more grooves 234 may be provided in the heater 200 for technological needs, such as to facilitate placing of the heater 200 into the hollow cathode, facilitate positioning of the heater 200 in the hollow cathode, and so forth.

As shown in FIG. 2, the cut 208 may be in a shape of a spiral slit 212 located around the side wall 206 to form a spiral shaped wall 214. The spiral slit 212 in the side wall 206 creates a plurality of spiral turns 216 of the spiral shaped wall 214. The ratio of a width 222 of a spiral turn 216 of the spiral shaped wall 214 to a width 224 of the spiral slit 212 may be 1.8 to 1. For example, the width 224 of the spiral slit 212 may be 1 millimeter (with a tolerance of −0.2 millimeters in some embodiments) and the width 222 of the spiral turn 216 of the spiral shaped wall 214 may be 1.8 millimeters (with a tolerance of +0.2 millimeters in some embodiments).

The ratio of an internal diameter 226 of the spiral shaped wall 214 to an external diameter 228 of the spiral shaped wall 214 may be 8 to 11. For example, the internal diameter 226 of the spiral shaped wall 214 may be 8 millimeters and the external diameter 228 of the spiral shaped wall 214 may be 11 millimeters.

The ratio of a length 230 of the spiral shaped wall 214 to the external diameter 228 of the spiral shaped wall 214 may be 18 to 11. For example, the length 230 of the spiral shaped wall 214 may be 18 millimeters and the external diameter 228 of the spiral shaped wall 214 may be 11 millimeters.

The ratio of an external diameter 232 of the thickening 204 to the external diameter 228 of the spiral shaped wall 214 may be 14 to 11. For example, the external diameter 232 of the thickening 204 may be 14 millimeters and the external diameter 228 of the spiral shaped wall 214 may be 11 millimeters.

The ratio of the length 230 of the spiral shaped wall 214 to a length 220 of the tube 202 (with the thickening 204) may be 9 to 13. For example, the length 230 of the spiral shaped wall 214 may be 18 millimeters and the length 220 of the tube 202 (with the thickening 204) may be 26 millimeters.

The two electrical current leads 210 may provide the direct current to the heater 200 from an external power supply source. The length of the electrical current leads 210 may be selected based on predetermined requirements and depending on a structure of the hollow cathode. In the example embodiment of FIG. 2, the diameter of at least one of the two electrical current leads 210 may be 1 millimeter. The ratio of a length 218 of the at least one of the two electrical current leads 210 to the length 220 of the tube 202 (with the thickening 204) may be about 5 to 2. For example, the length 218 of the two electrical current leads 210 may be 65 millimeters and the length 220 of the tube 202 (with the thickening 204) may be 26 millimeters.

Figure 3:
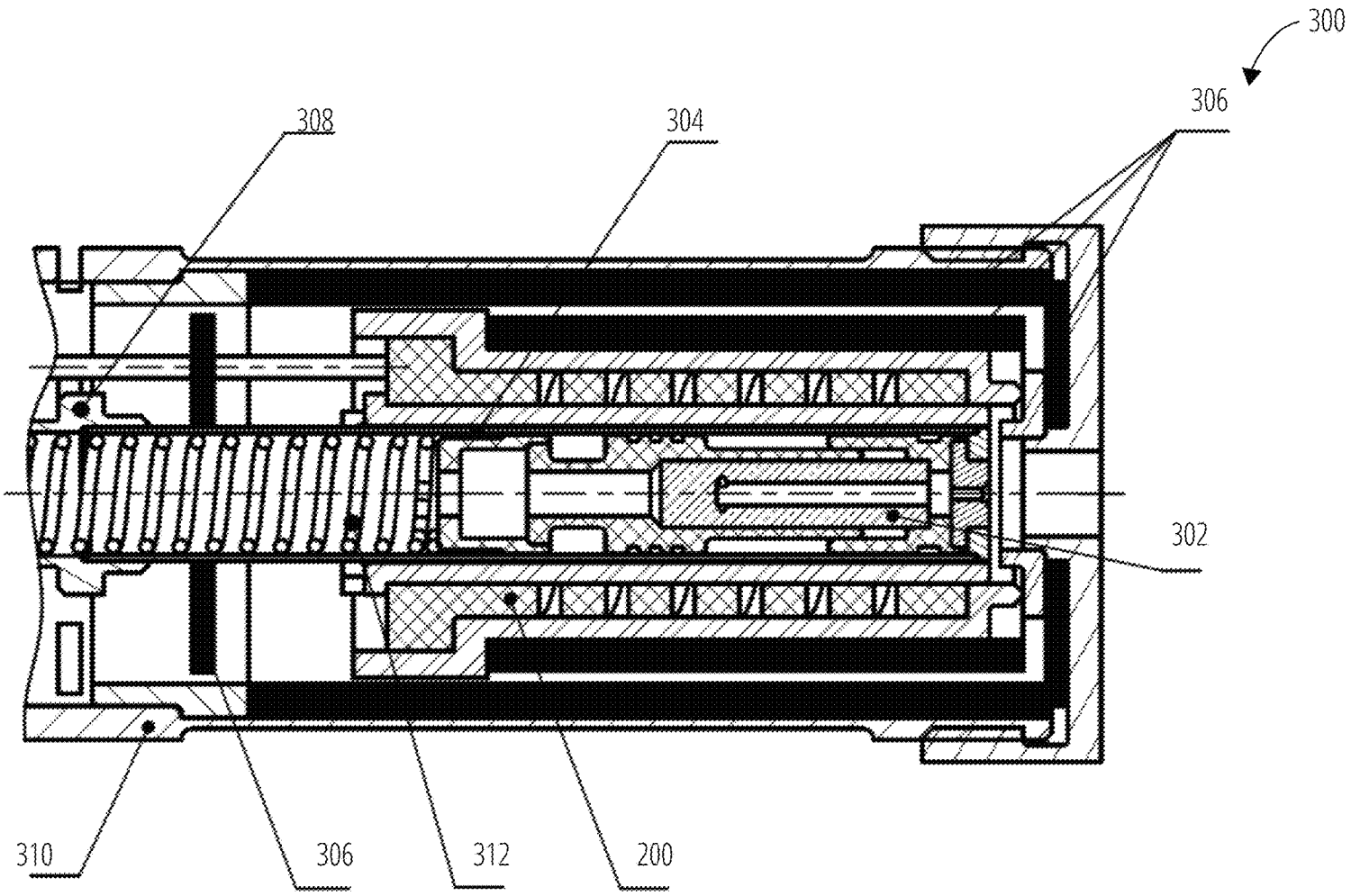
FIG. 3 is a diagram of a hollow cathode with a heater made of a carbon fiber composite, according to an example embodiment.

FIG. 3 is a diagram of a hollow cathode 300 with a heater made from a carbon fiber composite, according to an example embodiment. The hollow cathode 300 shown in FIG. 3 is a hollow cathode with a $LaB_6$-based emitter. The hollow cathode 300 may include an emitter 302, a working tube 304, a heater 200 made from the carbon fiber composite, heat shields 306, a flange 308 of the working tube 304, a keeper 310, and a spring 312 for fixing the emitter 302.

The specific property of the carbon fiber composite used for manufacturing of the heater 200 of the hollow cathode 300 is that the electrical resistance of the heater 200 is maximum at the low temperature of the heater 200 and decreases when the temperature of the heater 200 increases. This is why the carbon fiber composite used for the heater 200 is fundamentally different from the conventional heater made of the W-Re alloy. The electrical resistance of the W-Re alloy is minimal at the low temperature of the heater, which leads to significant pulse currents upon turning on of the heater.

Figure 4:
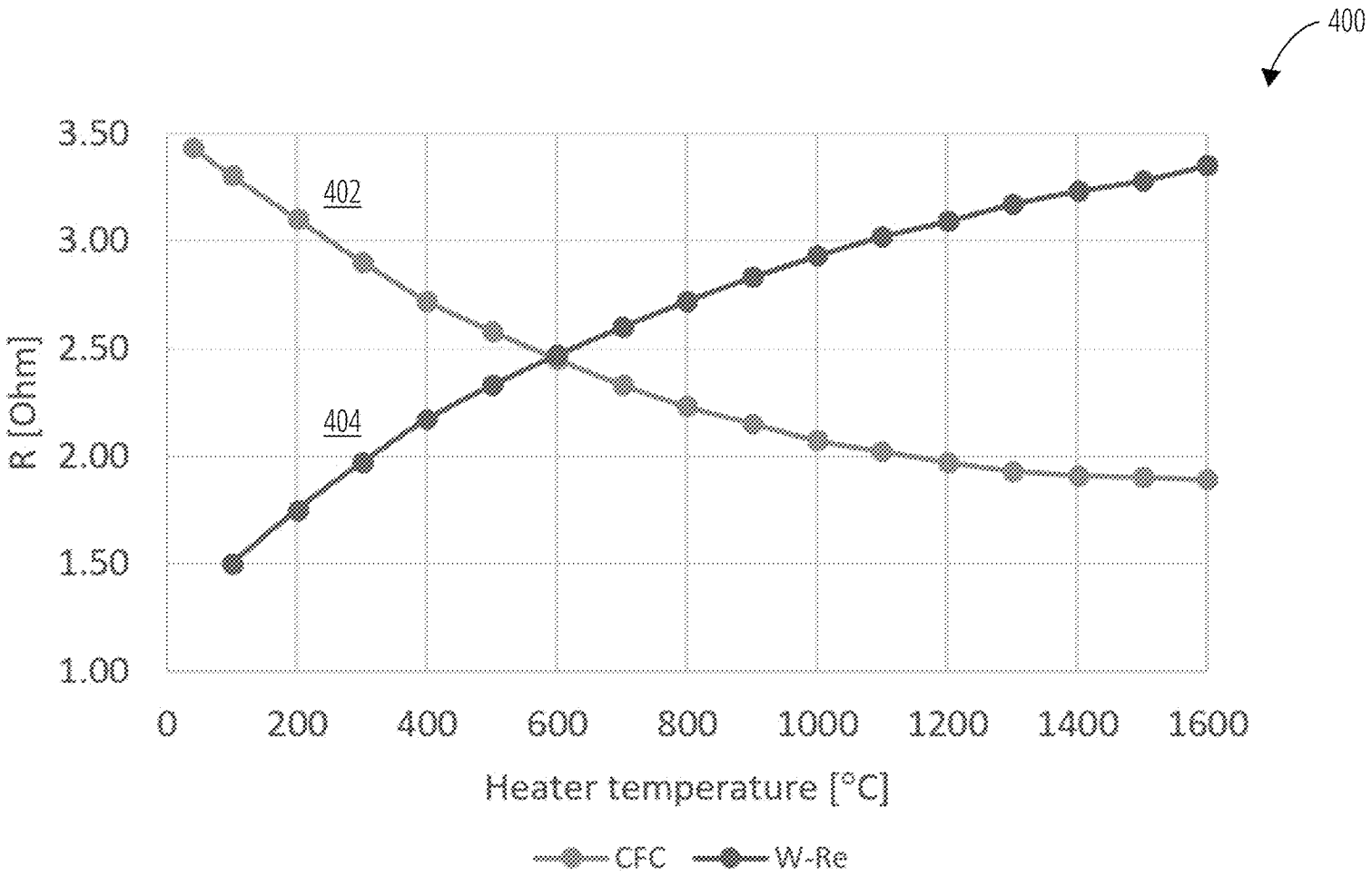
FIG. 4 is a plot of the electrical resistance of a heater made of the carbon fiber composite and the electrical resistance of a heater made of a tungsten-rhenium alloy, according to an example embodiment.

FIG. 4 is a plot 400 illustrating the electrical resistance 402 (R, Ohm) of a heater made from the carbon fiber composite and the electrical resistance 404 of a heater made from a W-Re alloy material as functions of the temperature (heater temperature, ° C.), according to an example embodiment. FIG. 4 illustrates the experimental studies of the effect of the temperature of the heater made of the carbon fiber composite and the heater made of the W-Re alloy material on the electrical resistance of the heaters.

The electrical resistance 404 of the heater made from a W-Re alloy material increases with an increase of temperature. In contrast, the electrical resistance 402 of the heater made from the carbon fiber composite decreases with the increase of temperature. Thus, when the heater made of the carbon fiber composite is used in the hollow cathode, it excludes the occurrence of overloads of the current in the heater when the heater is turning on. The heating process runs more smoothly as compared to a conventional heater made of the W-Re alloy material, which increases the reliability of the hollow cathode.

Thus, using the carbon fiber composite as a material of the heater of the hollow cathode eliminates the disadvantages specific to conventional heaters made of the W-Re alloy material and thereby significantly increases the reliability and service life of the hollow cathode.

Laboratory tests were carried out for a heater made of the carbon fiber composite installed in a hollow cathode with an emitter made of the $LaB_6$ material. The hollow cathode and the emitter were designed for electric propulsion thrusters developed by Space Electric Thruster Systems (SETS). The laboratory tests confirmed the advantages of the carbon fiber composite in heaters in comparison with conventional materials used for heaters of hollow cathodes.

Thus, the use of heaters made of the carbon fiber composite may be advantageous for use in hollow cathodes of electric propulsion thrusters that operate in the temperature range of 1000 to 1600° C. in vacuum.

Figure 5:
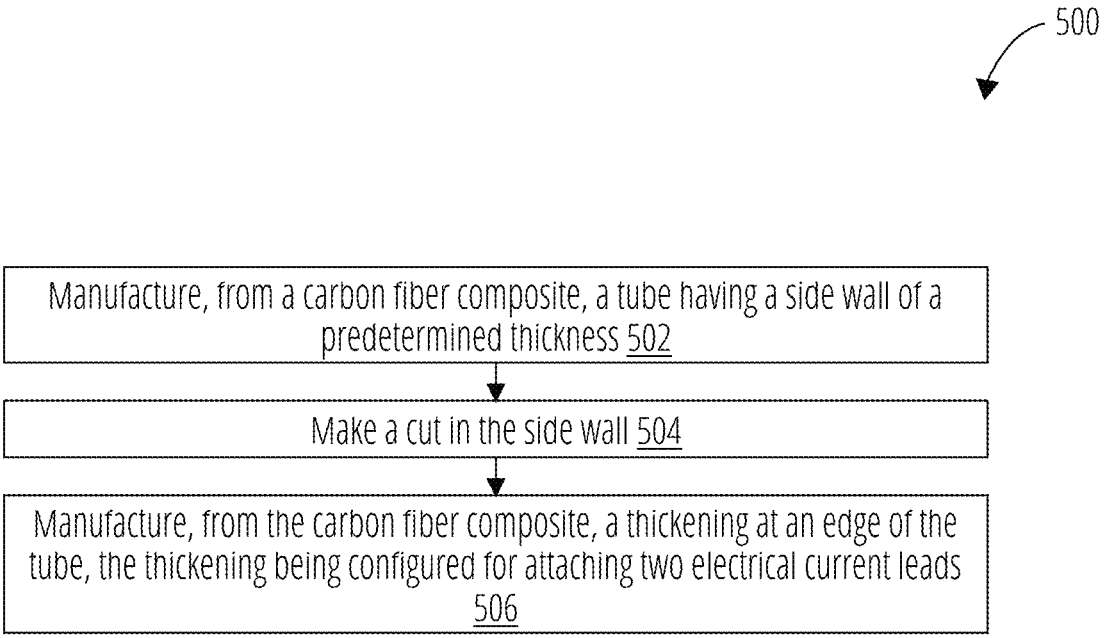
FIG. 5 illustrates a method for manufacturing a heater for a hollow cathode, according to an example embodiment.

FIG. 5 is a flow chart of a method 500 for manufacturing a heater for a hollow cathode, according to some example embodiments. In some embodiments, the operations may be combined, performed in parallel, or performed in a different order. The method 500 may also include additional or fewer operations than those illustrated.

The method 500 may commence in block 502 with manufacturing, from a carbon fiber composite, a tube having a side wall of a predetermined thickness. In block 504, the method 500 may continue with making a cut in the side wall. The thickening may be configured for attaching two electrical current leads.

In block 506, the method 500 may further include manufacturing, from the carbon fiber composite, a thickening at an edge of the tube. The tube and the thickening may be manufactured as a single part.

In an example embodiment, the cut may be in a shape of a slit directed lengthwise along the side wall. In another example embodiment, the cut may be in a shape of a spiral slit located around the side wall to form a spiral shaped wall. The ratio of the width of a spiral turn of the spiral shaped wall to the width of the spiral slit may be 1.8 to 1. For example, the width of the spiral turn of the spiral shaped wall may be 1.8 millimeters and the width of the spiral split may be 1 millimeter. The ratio of the external diameter of the thickening to the external diameter of the spiral shaped wall of the tube may be 14 to 11.

The ratio of the length of the spiral shaped wall to the length of the tube may be 9 to 13. The ratio of the internal diameter of the spiral shaped wall to the external diameter of the spiral shaped wall may be 8 to 11. The ratio of the length of the spiral shaped wall to the external diameter of spiral shaped wall may be 18 to 11.

The diameter of both electrical current leads depends on the magnitude of the heater's current. In some embodiments, the diameter of electrical current leads may be 1 millimeter. The ratio of the length of each of electrical current leads to the length of the tube may be 5 to 2.

Thus, a heater for a hollow cathode and a method for manufacturing a heater for a hollow cathode are disclosed. While the present embodiments have been described in connection with a series of embodiments, these descriptions are not intended to limit the scope of the subject matter to the particular forms set forth herein. It will be further understood that the methods are not necessarily limited to the discrete components described. To the contrary, the present descriptions are intended to cover such alternatives, modifications, and equivalents as may be included within the spirit and scope of the subject matter as disclosed herein and defined by the appended claims and otherwise appreciated by one of ordinary skill in the art.

What is claimed is:

1. A heater for a hollow cathode, the heater comprising:
a tube having a side wall of a predetermined thickness and a cut in the side wall; and a thickening located at an edge of the tube and configured for attaching two electrical current leads, the tube and the thickening including a carbon fiber composite.

2. The heater of claim 1, wherein the cut is in a shape of a slit directed lengthwise alongside the side wall.

3. The heater of claim 1, wherein the cut is in a shape of a spiral slit located around the side wall to form a spiral shaped wall.

4. The heater of claim 3, wherein a ratio of a width of a spiral turn of the spiral shaped wall to a width of the spiral slit is 1.8 to 1.

5. The heater of claim 4, wherein the width of the spiral slit is 1 millimeter.

6. The heater of claim 4, wherein a ratio of an internal diameter of the spiral shaped wall to an external diameter of the spiral shaped wall is 8 to 11.

7. The heater of claim 6, wherein a ratio of a length of the spiral shaped wall to the external diameter of the spiral shaped wall is 18 to 11.

8. The heater of claim 6, wherein a ratio of an external diameter of the thickening to the external diameter of the spiral shaped wall is 14 to 11.

9. The heater of claim 6, wherein a ratio of a length of the spiral shaped wall to a length of the tube is 9 to 13.

10. The heater of claim 6, wherein:

a diameter of at least one of the two electrical current leads is 1 millimeter; and a ratio of a length of the at least one of the two electrical current leads to a length of the tube is 5 to 2.

11. A method for manufacturing a heater for a hollow cathode, the method comprising:

manufacturing, from a carbon fiber composite, a tube having a side wall of a predetermined thickness;

making a cut in the side wall; and manufacturing, from the carbon fiber composite, a thickening at an edge of the tube, the thickening being configured for attaching two electrical current leads.

12. The method of claim 11, wherein the cut is in a shape of a slit directed lengthwise alongside the side wall.

13. The method of claim 11, wherein the cut is in a shape of a spiral slit located around the side wall to form a spiral shaped wall.

14. The method of claim 13, wherein a ratio of a width of a spiral turn of the spiral shaped wall to a width of the spiral slit is 1.8 to 1.

15. The method of claim 14, wherein the width of the spiral slit is 1 millimeter.

16. The method of claim 14, wherein a ratio of an internal diameter of the spiral shaped wall to an external diameter of the spiral shaped wall is 8 to 11.

17. The method of claim 16, wherein a ratio of a length of the spiral shaped wall to the external diameter of spiral shaped wall is 18 to 11.

18. The method of claim 16, wherein a ratio of an external diameter of the thickening to the external diameter of the spiral shaped wall is 14 to 11.

19. The method of claim 16, wherein a ratio of a length of the spiral shaped wall to a length of the tube is 9 to 13.

20. The method of claim 16, wherein:

a diameter of at least one of the two electrical current leads is 1 millimeter; and a ratio of a length of the at least one of the two electrical current leads to a length of the tube is 5 to 2.

* * * * *